US005439113A

United States Patent [19]

Elvin-Jensen

[11] Patent Number: 5,439,113

[45] Date of Patent: Aug. 8, 1995

[54] BULK CONTAINER

[75] Inventor: Flemming Elvin-Jensen, West Vancouver, Canada

[73] Assignee: MacroPlastics, Inc., Fairfield, Calif.

[21] Appl. No.: 397,539

[22] Filed: Mar. 2, 1995

Related U.S. Application Data

[63] Continuation of Ser. No. 79,350, Jun. 18, 1993, abandoned, which is a continuation-in-part of Ser. No. 73,410, Jun. 7, 1993, abandoned.

[51] Int. Cl.[6] ..... B65D 21/00

[52] U.S. Cl. ..... 206/509; 206/511; 220/1.5

[58] Field of Search ..... 206/503, 509, 511, 513; 220/1.5, 645

[56] References Cited

U.S. PATENT DOCUMENTS

| | | | |
|---|---|---|---|
| 3,214,056 | 10/1965 | Box | 206/511 X |
| 3,442,418 | 5/1969 | Stromberg | 220/645 |
| 3,481,502 | 12/1969 | Slayman | 206/511 X |
| 3,680,735 | 8/1972 | Lucas | 206/511 |
| 4,197,958 | 4/1980 | Zeni et al. | 220/1.5 X |
| 4,674,647 | 6/1987 | Gyenge et al. | 220/1.5 |
| 5,184,726 | 2/1993 | Box | 206/509 |

*Primary Examiner*—Steven M. Pollard
*Attorney, Agent, or Firm*—Graham & James

[57] ABSTRACT

A bulk container integrally molded from a plastic material and providing substantially exclusive transfer of vertical loads thru the corners of a lower container during stacking, and increased volumetric capacity. The front, rear and side sections of the container are integrally formed with a bottom wall portion to form a containment volume with a plurality of corners. A plurality of nesting protrusions extend downwardly from the lower portion of the corners and a corresponding plurality of nesting recesses are formed in the upper portion of the corners so that two containers can be vertically stacked with each protrusion mated with a corresponding recess. The corners include reinforcing vertical column portions having inwardly spaced wall portions blending into containment wall portions. The containment wall portions extend outwardly from the inwardly spaced wall portions. The bottom wall portion tapers downwardly in the direction outward from the center and blends into the lower regions of the containment wall portions. Vertical load transfer occurs between the upper container protrusions and the corresponding recess, vertical column portions and protrusions of the underlying container.

22 Claims, 5 Drawing Sheets

BULK CONTAINER

This is a continuation of application Ser. No. 08/079,350 filed Jun. 18, 1993, now abandoned which application is a continuation-in-part of U.S. patent application Ser. No. 08/073,410 entitled Bulk Container, filed Jun. 7, 1993, now abandoned.

BACKGROUND OF THE INVENTION

This invention relates to bulk containers of the type used to store and transport large quantities of agricultural produce, and industrial and other products.

Bulk containers are used for the storage and transport of large quantities of various kinds of items, such as agricultural produce, industrial products and the like. Such a container is disclosed in U.S. Pat. No. 5,180,064 issued Jan. 19, 1993 for "CONTAINER", the disclosure of which is hereby incorporated by reference. The bulk container disclosed in the '064 patent is a one piece molded plastic container having compound formed front, rear and side portions joined by a base wall portion. The base wall portion is elevated from the bottom of the container by means of integrally formed leg sections extending front to rear which support the container on the ground or some other support surface. The two outer leg sections are provided with removable foot members formed in the shape of channel sections which are removably inserted into the hollow underside of the foot portions. Integrally molded corner column support portions provide structural reinforcement for the container. The '064 container is also provided with a novel integral slide entry both fore and aft to facilitate the entry of the tines of a forklift along the underside of the container from either the front or the rear when the container needs to be elevated or transported to another location. The integral slide entry includes a plurality of longitudinally extending arcuate ribs formed along the underside of the base wall portion and extending outwardly of the containment wall portion of the front and rear portion.

Bulk containers are designed not only for individual, free standing use but also for stacking so that the containers and their contents can be efficiently stored and transported. For this purpose, most bulk containers have a bottom external support structure dimensioned to be partially accommodated within the inner periphery of the top rim of another like container for stacking. More particularly, the bottom edge of the container base (or the foot members in the case of the '064 container) typically extends laterally inwardly and then downwardly so as to be received within the inner periphery of the top rim of the underlying container. When stacked, the outer bottom edge of the upper container engages at least portions of the upper surface of the rim of the lower container, so that the vertical load of the upper container is distributed through the engaged portion of rim and the wall structure of the lower container. This design requires that the rim and wall portions have substantial strength in order to support the load of the upper container. While this does not pose a problem for containers made of structurally rigid materials, such as steel, problems are encountered with containers fabricated from substantially less rigid materials, such as molded plastics. In addition, the vertical load imposes substantial stress on the joint between the lateral extension and the downward excursion of the bottom edge of the upper container due to the cantilevered nature of the mechanical configuration. As a consequence, this part of the container typically experiences premature failure unless reinforced by additional strengthening pieces or the provision of thicker amounts of material where the maximum forces are encountered.

Bulk containers should also ideally be designed to outside dimensions which afford a maximum containment volume while still not exceeding the maximum dimensions required for warehousing or transporting such containers in transport trucks and rail cars. The '064 bulk container sacrifices some available internal containment volume by virtue of the fact that the containment wall portions of the front, rear and side portions are displaced inwardly of the outer surfaces.

SUMMARY OF THE INVENTION

The invention comprises an improved bulk container which avoids entirely the problem encountered with the cantilevered force effect experienced in known containers and which provides an increased volumetric capacity without expanding the outer dimensions of a comparably sized container.

In one aspect, the invention comprises a bulk container having front, rear and side sections integrally joined at the corners with vertical column support portions which provide vertical structural stability to the container. The front, rear and side sections each include an upper rim portion broached at the corners with recesses for receiving mating foot extensions of an upper container during stacking, which provide a transfer of vertical loads entirely through the corner column portions of the lower container during stacking. The recesses are preferably formed at the corners of the upper rim portion and terminate at an intermediate level between the upper surface of the rim and the upper surface of an inner ledge. The mating foot extensions are preferably designed to extend to the outermost portion of the recesses to distribute the vertical load over the corner column region. The inner ledge is an integrally formed part of the front, rear and side sections of the container providing horizontal structural stability to the bulk container.

From another aspect of the invention, improved volumetric capacity is afforded by the structural shape of the vertical wall portions which extend outwardly from the inner reinforcing portions to a maximal position along the vertical run thereof. In addition, the invention includes a base wall structure having an essentially convex or domed upper surface which tapers downwardly in the outward run from the center to the outer portions thereof. This downwardly tapering upper surface affords additional space for the storage of products within the bulk container.

The invention also is provided with hollow vertical column portions accessible from underneath the container for the purpose of providing additional discrete vertical reinforcing members if additional support strength is required for the container.

For a fuller understanding of the nature and advantages of the invention, reference should be had to the ensuing detailed description taken in conjunction with the accompanying drawings.

DESCRIPTION OF THE PREFERRED EMBODIMENTS

Figure 1:
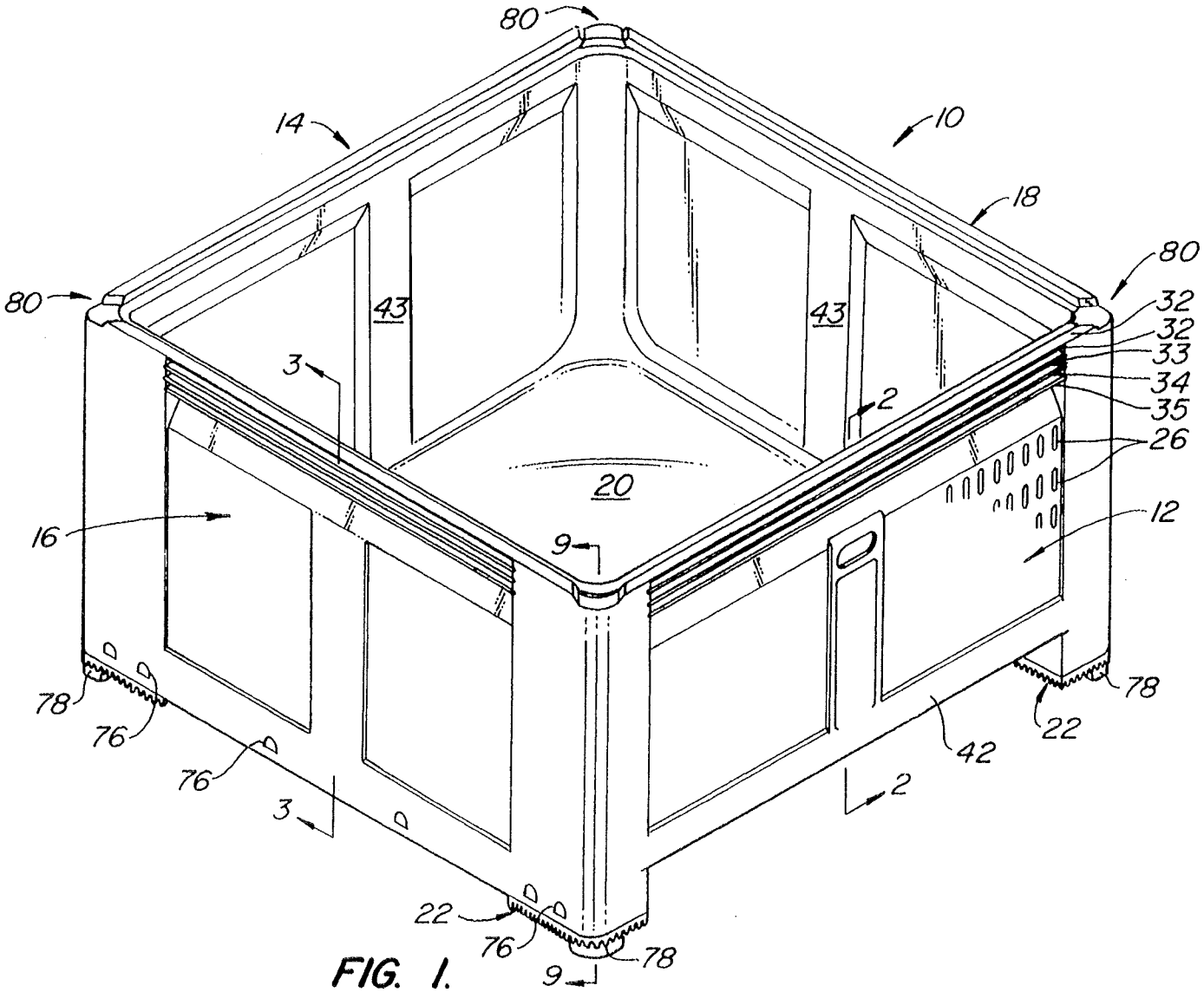
FIG. 1 is a perspective view showing a preferred embodiment of the invention.

Turning now to the drawings, FIG. 1 is a perspective view of the preferred embodiment of the invention. As seen in this Fig., a bulk container generally designated with reference numeral 10 has front and rear sections generally designated with reference numerals 12, 14, respectively, and side sections generally designated with reference numerals 16, 18. Bulk container 10 is a unitary structure preferably manufactured by injection molding, using a suitable molding material such as high density polyethylene, polypropylene or other suitable polyolefins. Sections 12, 14, 16 and 18 are joined at the lower inner portions thereof by a base wall portion 20 to form an open containment volume for the bulk storage of agricultural produce or industrial products.

Container 10 is supported on the bottom along the side sections thereof by means of removable foot members 22 which are received within a recess formed in the bottom portions of the side sections 16, 18. These structures are described more fully below.

Figure 2:
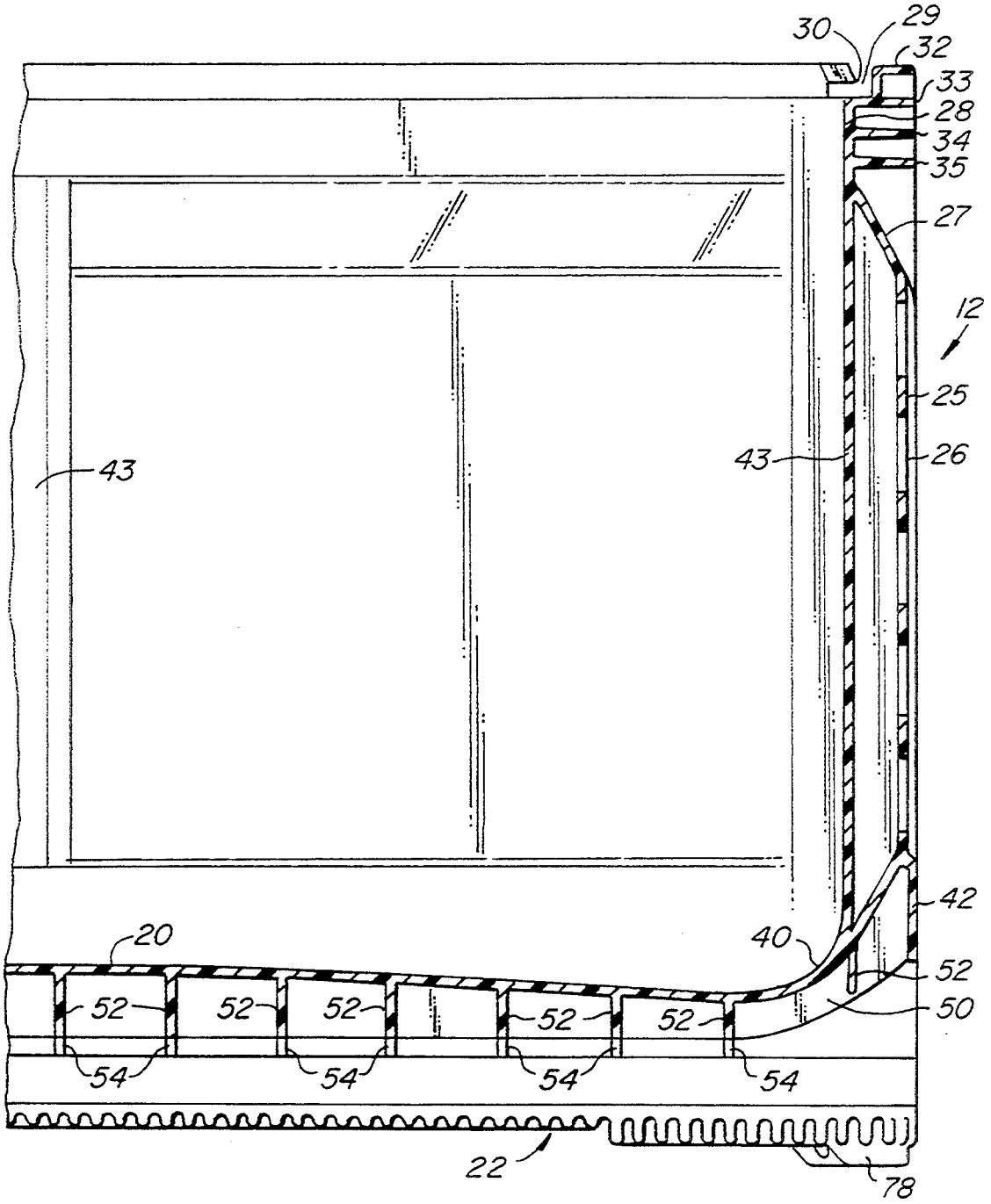
FIG. 2 is a sectional view taken along lines 2—2 of FIG. 1 illustrating the front and bottom wall structure.

With reference to FIG. 2, front section 12 has a perforated wall portion 25 provided with ventilation apertures 26. The upper edge of wall portion 25 tapers inwardly along transition 27 towards an upper portion with a vertically extending part 28 forming the upper inner wall surface. Part 28 blends into an outwardly extending horizontal ledge 29, which in turn blends into an upper extending segment 30 terminating in an outwardly extending rim portion 32. A plurality (3) of transversely extending stiffening ribs 33–35 are integrally formed to the part 28 as shown in FIG. 2.

The lower end of vertical wall portion 25 blends along a radius 40 into the outer edge of base wall portion 20. In addition, a downwardly depending outward part 42 extends from the juncture of the radius portion 40 and the lower edge of vertical wall portion 25.

Front section 12 is provided with an intermediate vertical column support portion with an inner wall structure 43 which provides additional vertical rigidity to the front section 12.

Along the underside of base wall portion 20 are a plurality of integral slide entry ribs 50 (only one of which is visible in FIG. 2) which curve upwardly in the outward direction and terminate at part 42. A plurality of transversely extending support ribs 52 extend downwardly from the underside of base wall portion 20 to provide lateral rigidity. Ribs 52 terminate at the lower edge of the integral slide entry ribs 50 to accommodate sliding entry of the tines of a forklift (not illustrated) in the manner described in the '064 patent. Additional transverse ribs 54 are provided along the underside of base wall portion 20 outboard of the integral slide entry region of the container. The sectional structure of the rear section 14 is the same as that of the front section 12 illustrated in FIG. 2.

Figure 3:
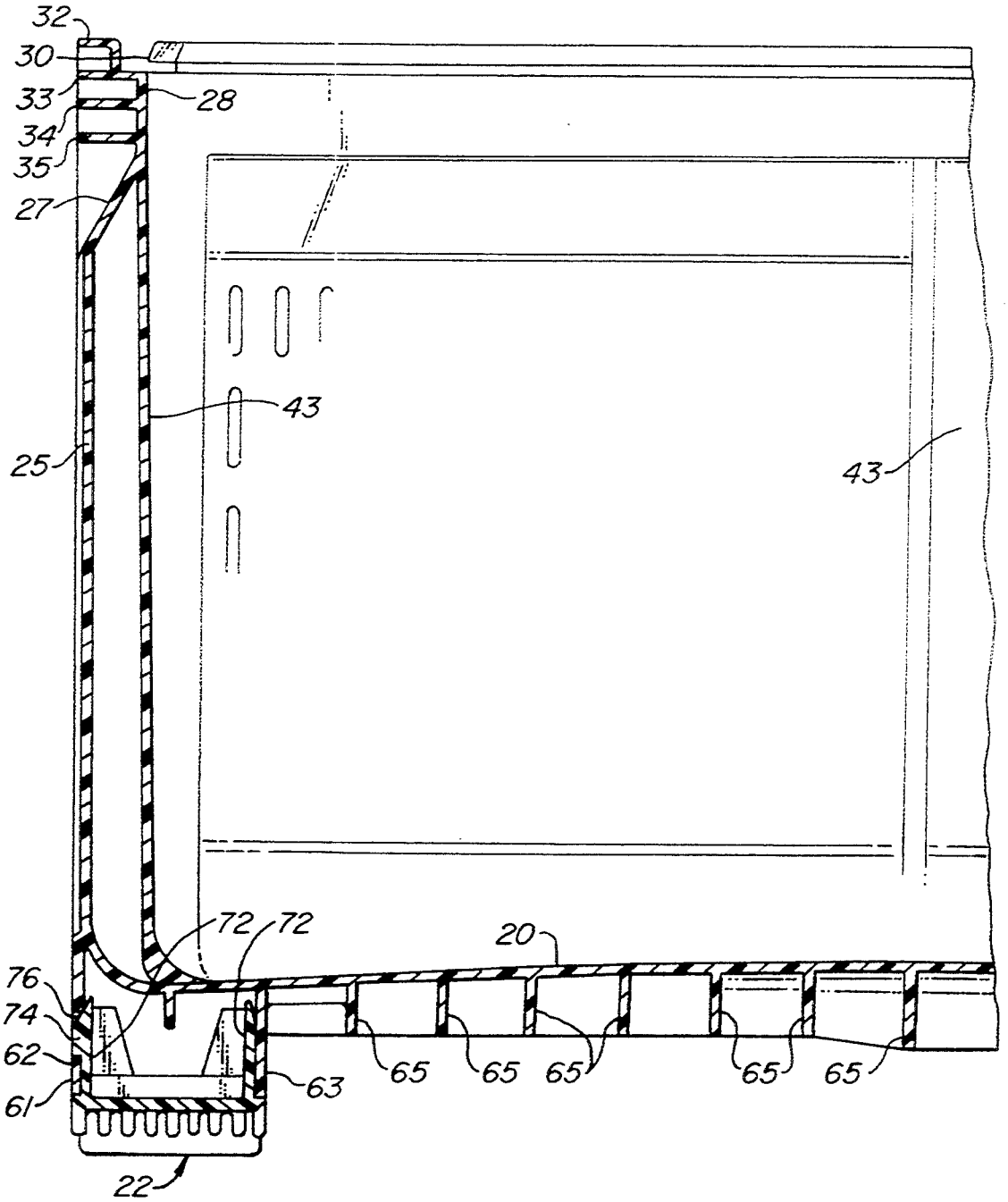
FIG. 3 is a sectional view taken along lines 3—3 showing the side and bottom wall structure.

FIG. 3 illustrates the sectional wall structure of the left side section 16. As is evident from FIG. 3, the construction of the central and uppermost portions of side section 16 are similar to that already described above with reference to FIG. 2. The lower portion, however, includes a downwardly depending outer foot wall part 61 having a plurality of apertures 62 for a purpose to be described. A matching inner foot wall part 63 depends downwardly from base wall portion 20. A plurality of longitudinally extending ribs 65 depend downwardly from bottom wall 20. Some of these ribs 65 may comprise the extension of integral slide entry ribs 50. In the alternative, ribs 65 may comprise additional longitudinal extending ribs spaced intermediate the integral slide entry ribs at locations which do not interfere with the integral slide entry function.

As will be apparent from a comparison of FIGS. 2 and 3, base wall portion 20 has a somewhat convex upper surface with an upper wall surface which gradually descends as it runs from the center toward the outer regions thereof. This downwardly tapering configuration, in combination with the outward placement of the wall portions 25, afford additional volumetric capacity to the container over known devices. As an example, a bulk container fabricated according to this aspect of the invention to dimensions of 47 $\frac{3}{4}$ in.×47 $\frac{3}{4}$ in×28 $\frac{1}{2}$ height was found to have a volumetric capacity approximately 12.8% greater than that of a bulk container fabricated in the style shown in the above-referenced '064 patent to dimensions of 47 in.×47 in.×28 $\frac{1}{4}$ in. height. Although the former has slightly larger dimensions, this increase only accounts for 4% of the difference. Thus, the improvement in volumetric capacity for this example is about 8.8%.

Figure 4:
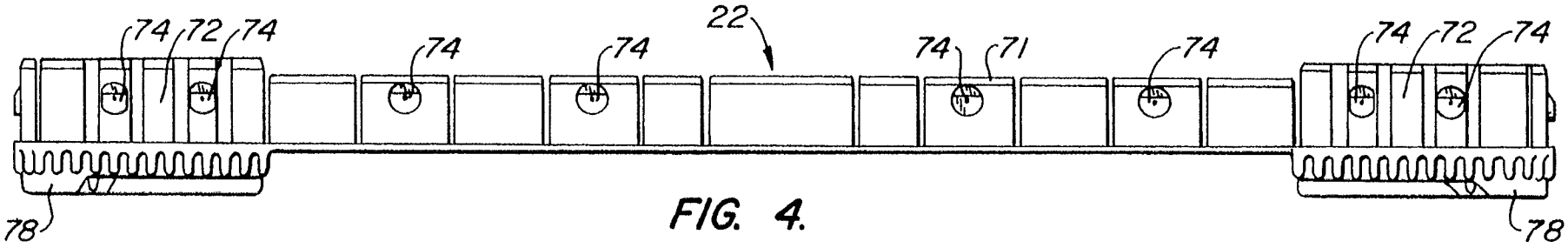
FIG. 4 is a side elevational view of a container foot.
Figure 5:
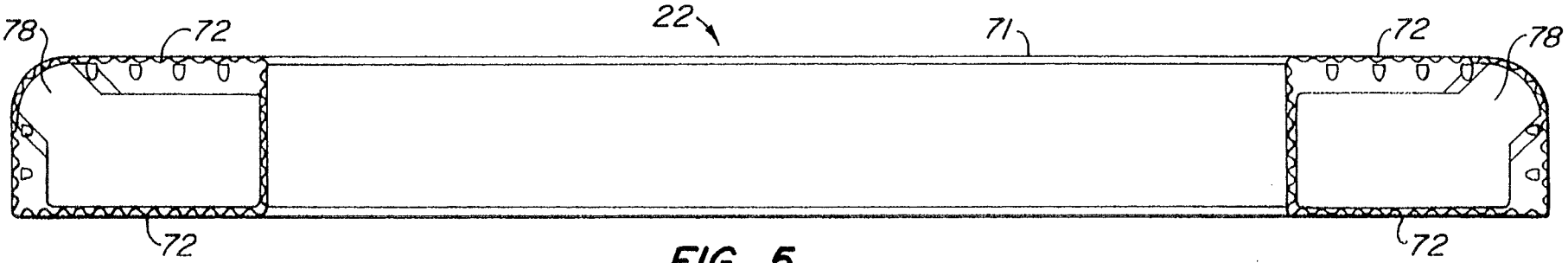
FIG. 5 is a bottom view of the foot of FIG. 4.

With reference to FIGS. 4 and 5, container 10 is supported from below by means of a pair of removable longitudinally extending foot members 22. Each foot member 22 has a central portion 71 terminating at either end in a foot pad having upstanding walls 72 dimensioned to be received within the space afforded by downwardly depending wall parts 61, 63 (FIG. 3) of the side sections 16, 18. Foot member 22 is provided with a plurality of integrally molded tab portions 74 designed to snap fit into mounting apertures 76 formed along the lower part of side sections 16, 18.

A significant feature of the invention is the provision for the exclusive transfer of vertical loads through the corners of a lower container from an upper stacked container. This function is accomplished by means of a plurality of nesting recesses distributed about the upper periphery of the container and corresponding nesting protrusions extending downwardly from the corners of the foot members 70. As best seen in FIGS. 1, and 6–8, the upper rim of container 10 is broached at each corner and a recess 80 is provided at each corner. Each recess 80 is designed to accommodate the protrusion 78 from a mating corner of an associated foot member 22. Each protrusion 78 extends over the corner region and terminates at a location substantially coextensive with the outer wall extremity of a given recess 80 so as to distribute the vertical load over the entire corner region. The container rim 32 slopes downwardly adjacent the corner portion to an intermediate level 82 above the inner ledge 29 by means of tapered walls 83. The dimensions selected for each recess 80 match the extent of the nesting projections 78 on the foot members 22. Consequently, when one container 10 is to be stacked on top of another, the upper container 10 is carefully lowered down onto the lower container such that the foot protrusions 78 are received within the nesting recesses 80 in the rim 32. Once registered, the protrusions 78 are nested into the recesses 80 and vertical loads are transferred substantially exclusively through the corner portions of the underlying container either to ground support directly or to another underlying container (in the case in which three or more containers are stacked). In addition, stability is provided in orthogonal directions so that the upper container 10 cannot be dislodged from its nested position by jostling but must be lifted until the protrusions 78 clear the recesses 80.

Figure 9:
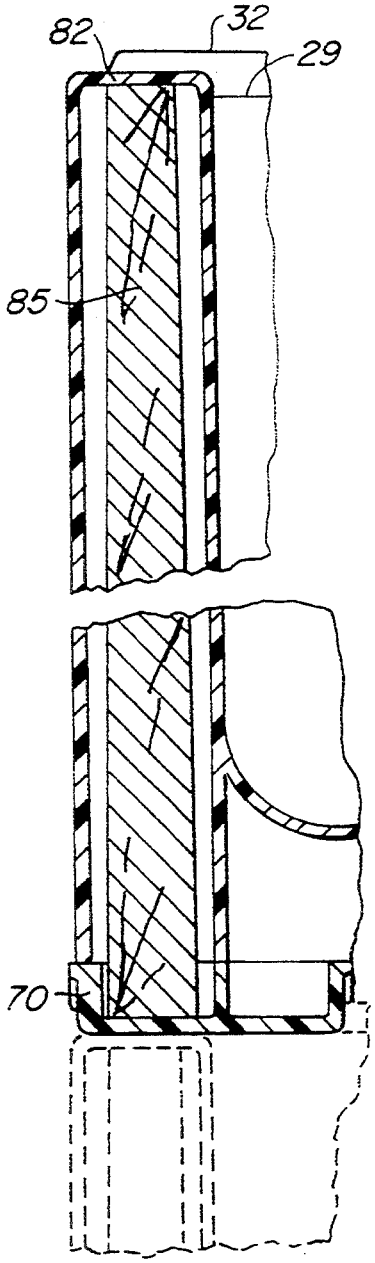
FIG. 9 is a sectional view taken along lines 9—9 of FIG. 1 illustrating the use of an additional discrete vertical column support.

Although the container 10 is designed to provide substantial vertical support for storage, nesting and transportation purposes, additional vertical support capability can be added to the basic container in the following manner. With reference to FIG. 9, the corner portions of the container have a hollow structure which can be accessed from below (by removing the corresponding foot member 22) in order to expose the internal volume. After exposure, a discrete support column 85 can be inserted from below and retained within the inner volume by replacing the foot member 70. Thus installed, the top end of the column support 85 rests on the underside of the nesting recess 80 while the bottom end of column support 85 rests on the inner upper surface of the corner portion of the foot member 22. Thus, any load placed on recessed surface 82 by means of an upper nested container can be transferred not only through the container corner structure but also thru support column 85 to the foot member 22 and into the support below the lower container.

Figure 10:
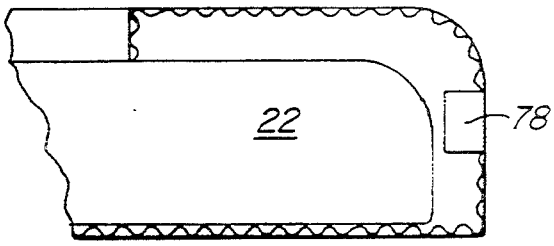
FIGS. 10 and 11 are fragmentary bottom views illustrating alternate nesting protrusions on the bottom foot.
Figure 11:
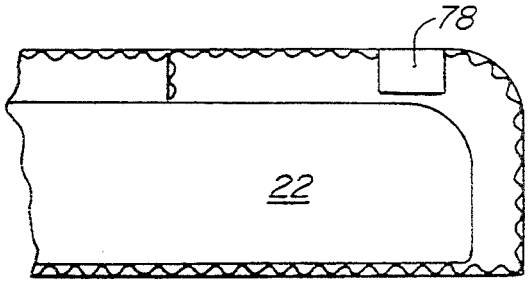
Figure 6:
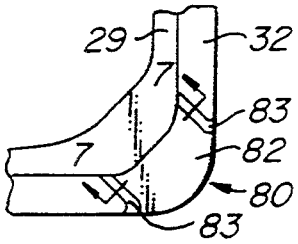
FIG. 6 is a fragmentary upper plan view of a corner of the invention illustrating the nesting recess.
Figure 7:
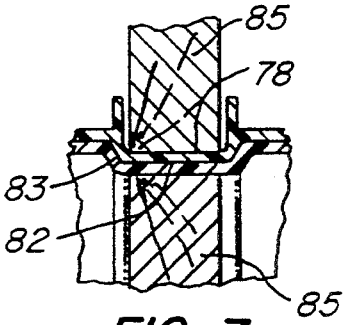
FIG. 7 is a sectional view taken along lines 7—7 of FIG. 6.
Figure 8:
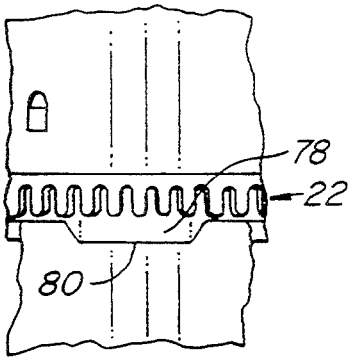
FIG. 8 is a detail view illustrating the nesting of two containers.

While the above provides a full and complete disclosure of the preferred embodiments of the invention, various modifications, alternate constructions and equivalents may be employed as desired. For example, although the nesting protrusions 78 and nesting recesses 80 have been described as being located exactly at the corners of the rim of the container 10, other placements may be suitable. Two such placements of the nesting protrusions are illustrated in FIGS. 10 and 11. It is understood that the placements are governed by the requirement that substantially all the load from the upper stacked container be transferred vertically via the strengthened vertical column portions of the container, regardless of whether these column portions are located at the exact corners of the container. The corresponding recesses would be formed in similar locations in the rim of the container 10. In addition, although only a portion of front section 12 has been illustrated and described as having ventilation apertures 26, such apertures may be provided in other sections 14, 16, 18 base wall portion 20, or not at all, depending on the requirements of a given application. Therefore, the above description and illustrations should not be construed as limiting the invention, which is defined by the appended claims.

What is claimed is:

1. A bulk container having front, rear, side and bottom sections forming a containment volume with a plurality of corner portions, at least some of said front, rear and side sections having an upper rim portion with an inner edge, an outer edge and a top surface and a plurality of nesting protrusions extending downwardly from said bottom section in association with a majority of said corner portions, said upper rim portion having a plurality of downwardly depending recesses associated to a majority of the corner portions, each said recess extending through the inner edge and the outer edge of said upper rim portion to form a gap therein, said recesses providing a corresponding plurality of nesting recesses formed in association with the upper corner portions so that two containers can be stacked with the nesting protrusions of the upper container received by the nesting recesses of the lower container with a substantially exclusive transfer of vertical load through the corner portions of the lower container.

2. The invention of claim 1 wherein said protrusions have an outer margin substantially coextensive with the outer margin of a nesting recess.

3. The invention of claim 1 further including an internal ledge extending along the upper inner portion of each section, and wherein each recess terminates at a level above the internal ledge.

4. The invention of claim 3 wherein each said recess includes a sloping side wall portion extending downwardly from said rim portion and terminating in a recess floor.

5. The invention of claim 1 wherein said sections are joined adjacent the corners of said bulk container by reinforcing vertical column portions providing a hollow interior, each column portion terminating at the upper end thereof beneath an associated recess so that a discrete vertical reinforcement member may be inserted into a hollow interior to provide additional column support.

6. The invention of claim 1 wherein each of said side sections is provided at the bottom thereof with a discrete foot member; and wherein said nesting protrusions comprise a portion of said foot member.

11. The invention of claim 10 wherein each said recess includes a sloping side wall portion extending downwardly from said rim portion and terminating in a recess floor.

7. The invention of claim 1 wherein said front, rear and side sections are integrally formed with said bottom wall section.

8. The invention of claim 1 wherein each said recess is positioned adjacent a different one of said plurality of corner portions.

9. The invention of claim 1 further including an internal ledge extending along the upper inner portion of at least some of said sections; and wherein each recess terminates at a level between said top surface of said rim portion and said internal ledge.

10. A bulk container with increased volumetric capacity and vertical stacking capacity, said container comprising front, rear, side and bottom sections forming a containment volume, said front, rear and side sections being joined at the corners of said bulk container by reinforcing vertical column portions having inwardly spaced wall portions blending into containment wall portions, said containment wall portions extending outwardly from said inwardly spaced wall portions, at least some of said front, rear and side sections having an upper rim portion with an inner edge, an outer edge and a top surface, and a plurality of nesting protrusions extending downwardly of said bottom section in association with a majority of said corner portions, said rim portions having a plurality of downwardly depending recesses associated to a majority of the corner portions, each said recess extending through the inner edge and the outer edge of said upper rim portion to form a gap therein, said recesses providing a corresponding plurality of nesting recesses formed in association with the upper portion of the corners so that vertical loads are transferred substantially exclusively via the corners of an underlying container when two containers are stacked.

12. The invention of claim 10 wherein said bottom wall portion tapers downwardly in the outward direction from the center thereof and blends into the lower end of the containment wall portions.

13. The invention of claim 10 wherein each of said side sections is provided at the bottom thereof with a discrete foot member; and wherein said nesting protrusions comprise a portion of said foot member.

14. The invention of claim 10 wherein said protrusions have an outer margin substantially coextensive with the outer margins of said recesses.

15. The invention of claim 10 further including an internal ledge extending along the upper inner portion of each section, and wherein each recess terminates at a level above the internal ledge.

16. The invention of claim 10 wherein said reinforcing vertical column portions provide a hollow interior, and wherein each column portion terminates at the upper end beneath an associated recess.

17. The invention of claim 10 wherein said front, rear and side sections are integrally formed with said bottom wall section.

18. The invention of claim 11 wherein each said recess is positioned adjacent a different one of said plurality of corner portions.

19. The invention of claim 10 further including an internal ledge extending along the upper inner portion of at least some of said sections; and wherein each recess terminates at a level between said top surface of said rim portion and said internal ledge.

20. A wall structure for a bulk container having front, rear, side and bottom sections, said container having at least two nesting protrusions extending downwardly from said bottom section, said wall structure comprising an upper rim portion extending along said wall structure and terminating at opposite ends at a corner portion thereof, said upper rim portion having an inner edge, an outer edge, a top surface and a pair of downwardly depending recesses each associated to a different one of said corner portions, each said recess extending through the inner edge and the outer edge of said upper rim portion to form a gap therein, said recesses providing a pair of nesting recesses formed in association with the upper corner portions so that two containers provided with said wall structure can be stacked with the nesting protrusions of an upper container received by the nesting recesses of a lower container with a substantially exclusive transfer of vertical load through the corner portions of the lower container.

21. The invention of claim 20 wherein each said recess is positioned adjacent a different one of said pair of corner portions.

22. The invention of claim 20 wherein said wall structure further includes an internal ledge extending along the upper inner portion thereof; and wherein each recess terminates at a level between said top surface of said upper rim portion and said internal ledge.

* * * * *

US005439113B1

REEXAMINATION CERTIFICATE (4060th)

United States Patent [19] [11] B1 5,439,113

Elvin-Jensen [45] Certificate Issued Apr. 25, 2000

[54] BULK CONTAINER

[75] Inventor: Flemming Elvin-Jensen, West Vancouver, Canada

[73] Assignee: MacroPlastics, Inc., Fairfield, Calif.

Reexamination Request:
No. 90/004,437, Oct. 29, 1996

Reexamination Certificate for:

| | |
|---|---|
| Patent No.: | **5,439,113** |
| Issued: | **Aug. 8, 1995** |
| Appl. No.: | **08/397,539** |
| Filed: | **Mar. 2, 1995** |

Related U.S. Application Data

[63] Continuation of application No. 08/079,350, Jun. 18, 1993, abandoned, which is a continuation-in-part of application No. 08/073,410, Jun. 7, 1993, abandoned.

[51] Int. Cl.[7] ..... B65D 21/00

[52] U.S. Cl. ..... 206/509; 206/511; 220/1.5

[58] Field of Search ..... 220/1.5, 657, 608; 206/509, 511, 503, 513

[56] References Cited

U.S. PATENT DOCUMENTS

| | | | |
|---|---|---|---|
| 1,112,943 | 10/1914 | Stone . | |
| 2,760,676 | 8/1956 | Knieriem et al. . | |
| 2,922,517 | 1/1960 | Nordquist et al. . | |
| 3,303,965 | 2/1967 | Parker et al. . | |
| 3,341,064 | 9/1967 | Ricci | 220/608 X |
| 3,380,616 | 4/1968 | Schoeller . | |
| 4,165,003 | 8/1979 | Drader . | |
| 4,226,192 | 10/1980 | Myers . | |
| 4,366,905 | 1/1983 | Forshee . | |
| 4,373,642 | 2/1983 | Wolters et al. | 220/657 X |
| 4,591,065 | 5/1986 | Foy . | |
| 4,674,647 | 6/1987 | Gyenge et al. | 220/1.5 |
| 4,757,910 | 7/1988 | Box . | |
| 5,332,114 | 7/1994 | Sano et al. . | |

FOREIGN PATENT DOCUMENTS

| | | |
|---|---|---|
| 0069419 | 6/1981 | European Pat. Off. . |
| 2266637 | 5/1975 | France . |
| 2635753 | 10/1988 | France . |
| 1109105 | 3/1966 | United Kingdom . |
| 2015969 | 3/1979 | United Kingdom . |

*Primary Examiner*—Steven M. Pollard

[57] ABSTRACT

A bulk container integrally molded from a plastic material and providing substantially exclusive transfer of vertical loads thru the corners of a lower container during stacking, and increased volumetric capacity. The front, rear and side sections of the container are integrally formed with a bottom wall portion to form a containment volume with a plurality of corners. A plurality of nesting protrusions extend downwardly from the lower portion of the corners and a corresponding plurality of nesting recesses are formed in the upper portion of the corners so that two containers can be vertically stacked with each protrusion mated with a corresponding recess. The corners include reinforcing vertical column portions having inwardly spaced wall portions blending into containment wall portions. The containment wall portions extend outwardly from the inwardly spaced wall portions. The bottom wall portion tapers downwardly in the direction outward from the center and blends into the lower regions of the containment wall portions. Vertical load transfer occurs between the upper container protrusions and the corresponding recess, vertical column portions and protrusions of the underlying container.

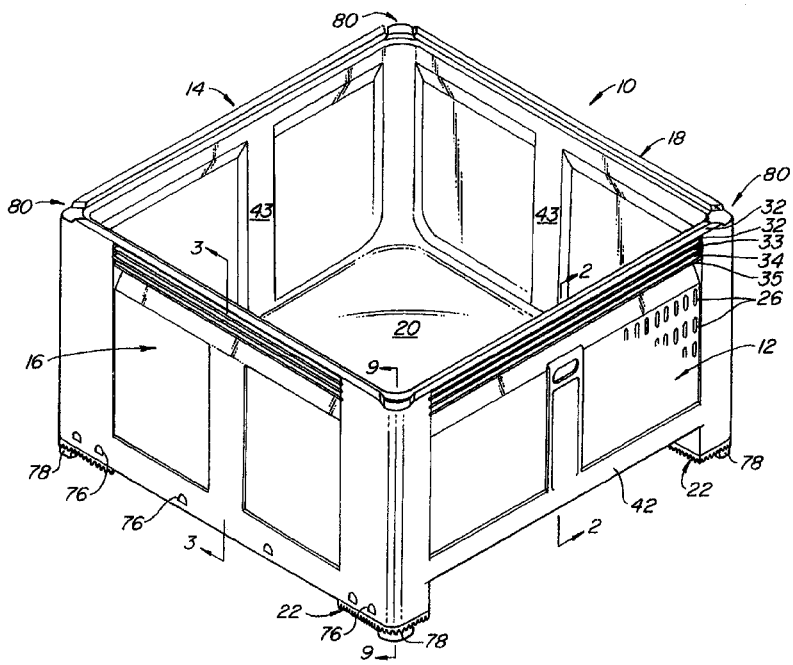

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2–4, 9, 14, 15, 19 and 22 is confirmed.

Claims 1, 5, 6–8, 10–13, 16–18, 20 and 21 are cancelled.

New claims 23–44 are added and determined to be patentable.

*23. A bulk container having front, rear, side and bottom wall sections forming a containment volume with a plurality of corner portions, at least some of said front, rear and side wall sections having an upper rim portion with an inner edge, an outer edge and a top surface and a plurality of nesting protrusions extending downwardly below said bottom wall section in association with a majority of said corner portions, said upper rim portion having a plurality of downwardly depending recesses associated to a majority of the corner portions, each said recess extending through the inner edge and the outer edge of said upper rim portion to form a gap therein, said recesses providing a corresponding plurality of nesting recesses formed in association with the upper corner portions so that two containers can be stacked with the nesting protrusions of the upper container received by the nesting recesses of the lower container with a substantially exclusive transfer of vertical load through the corner portions of the lower container.*

*24. The invention of claim 23 wherein said protrusions have an outer margin substantially coextensive with the outer margin of a nesting recess.*

*25. The invention of claim 23 further including an internal ledge extending along the upper inner portion of each wall section, and wherein each recess terminates at a level above the internal ledge.*

*26. The invention of claim 25 wherein each said recess includes a sloping side wall portion extending downwardly from said rim portion and terminating in a recess floor.*

*27. The invention of claim 23 wherein said wall sections are joined adjacent the corners of said bulk container by reinforcing vertical column portions providing a hollow interior, each column portion terminating at the upper end thereof beneath an associated recess so that a discrete vertical reinforcement member may be inserted into the hollow interior to provide additional column support.*

*28. The invention of claim 23 wherein each of said side wall sections is provided at the bottom thereof with a discrete foot member; and wherein said nesting protrusions comprise a portion of said foot member.*

*29. The invention of claim 23 wherein said front, rear and side wall sections are integrally formed with said bottom wall section.*

*30. The invention of claim 23 wherein each said recess is positioned adjacent a different one of said plurality of corner portions.*

*31. The invention of claim 23 further including an internal ledge extending along the upper inner portion of at least some of said wall sections; and wherein each recess terminates at a level between said top surface of said rim portion and said internal ledge.*

*32. A bulk container with increased volumetric capacity and vertical stacking capacity, said container comprising front, rear, side and bottom wall sections forming a containment volume, said front, rear and side wall sections being joined at the corners of said bulk container by reinforcing vertical column portions having inwardly spaced wall portions blending into containment wall portions, said containment wall portions extending outwardly from said inwardly spaced wall portions, at lease some of said front, rear and side wall sections having an upper rim portion with an inner edge, an outer edge and a top surface, and a plurality of nesting protrusions extending downwardly of said bottom wall section in association with a majority of said corner portions, said rim portions having a plurality of downwardly depending recesses associated to a majority of the corner portions, each said recess extending through the inner edge and the outer edge of said upper rim portion to form a gap therein, said recesses providing a corresponding plurality of nesting recesses formed in association with the upper portion of the corners so that vertical loads are transferred substantially exclusively via the corners of an underlying container when two containers are stacked.*

*33. The invention of claim 32 wherein each said recess includes a sloping side wall portion extending downwardly from said rim portion and terminating in a recess floor.*

*34. The invention of claim 32 wherein said bottom wall portion tapers downwardly in the outward direction from the center thereof and blends into the lower end of the containment wall portions.*

*35. The invention of claim 32 wherein each of said side wall sections is provided at the bottom thereof with a discrete foot member; and wherein said nesting protrusions comprise a portion of said foot member.*

*36. The invention of claim 32 wherein said protrusions have an outer margin substantially coextensive with the outer margins of said recesses.*

*37. The invention of claim 32 further including an internal ledge extending along the upper inner portion of each wall section, and wherein each recess terminates at a level above the internal ledge.*

*38. The invention of claim 32 wherein said reinforcing vertical column portions provide a hollow interior, and wherein each column portion terminates at the upper end beneath an associated recess.*

*39. The invention of claim 32 wherein said front, rear and side wall sections are integrally formed with said bottom wall section.*

*40. The invention of claim 32 wherein each said recess is positioned adjacent a different one of said plurality of corner portions.*

*41. The invention of claim 32 further including an internal ledge extending along the upper inner portion of at least some of said wall sections; and wherein each recess terminates at a level between said top surface of said rim portion and said internal ledge.*

*42. A wall structure for a bulk container having front, rear, side and bottom wall sections, said container having at least two nesting protrusions extending downwardly below said bottom wall section, said wall structure comprising an upper rim portion extending along said wall structure and terminating at opposite ends at a corner portion thereof, said upper rim portion having an inner edge, an outer edge,*

*a top surface and a pair of downwardly depending recesses each associated to a different one of said corner portions, each said recess extending through the inner edge and the outer edge of said upper rim portion to form a gap therein, said recesses providing a pair of nesting recesses formed in association with the upper corner portions so that two containers provided with said wall structure can be stacked with the nesting protrusions of an upper container received by the nesting recesses of a lower container with a substantially exclusive transfer of vertical load through the corner portions of the lower container.*

*43. The invention of claim 42 wherein each said recess is positioned adjacent a different one of said pair of corner portions.*

*44. The invention of claim 42 wherein said wall structure further includes an internal ledge extending along the upper inner portion thereof; and wherein each recess terminates at a level between said top surface of said upper rim portion and said internal ledge.*

* * * * *